US012559889B2

(12) United States Patent
Antony et al.

(10) Patent No.: US 12,559,889 B2
(45) Date of Patent: Feb. 24, 2026

(54) MACHINE AND METHOD FOR STABILISING A BALLAST TRACK

(71) Applicant: Plasser & Theurer Export von Bahnbaumaschinen Gesellschaft m.b.H., Vienna (AT)

(72) Inventors: Bernhard Antony, Stockerau (AT); Florian Auer, Vienna (AT); Fritz Kopf, Vienna (AT)

(73) Assignee: Plasser & Theurer Export von Bahnbaumaschinen Gesellschaft m.b.H., Vienna (AT)

( * ) Notice: Subject to any disclaimer, the term of this patent is extended or adjusted under 35 U.S.C. 154(b) by 825 days.

(21) Appl. No.: 17/779,346

(22) PCT Filed: Nov. 13, 2020

(86) PCT No.: PCT/EP2020/081990
§ 371 (c)(1),
(2) Date: May 24, 2022

(87) PCT Pub. No.: WO2021/115722
PCT Pub. Date: Jun. 17, 2021

(65) Prior Publication Data

US 2022/0403605 A1 Dec. 22, 2022

(30) Foreign Application Priority Data

Dec. 10, 2019 (AT) ..... A 390/2019

(51) Int. Cl.
*E01B 27/20* (2006.01)
*E01B 27/16* (2006.01)

(52) U.S. Cl.
CPC ..... *E01B 27/20* (2013.01); *E01B 27/16* (2013.01)

(58) Field of Classification Search
CPC ..... E01B 27/16; E01B 27/17; E01B 27/20; E01B 29/04; E01B 35/00; E01B 2203/127
See application file for complete search history.

(56) References Cited

U.S. PATENT DOCUMENTS 5,127,333 A * 7/1992 Theurer ..... E01B 27/20 73/146
5,257,579 A * 11/1993 Theurer ..... E01B 27/20 104/2

(Continued)

FOREIGN PATENT DOCUMENTS

CH 656658 A5 * 7/1986
DE 41 02 872 A1 8/1991

(Continued)

OTHER PUBLICATIONS

International Search Report of PCT/EP2020/081990, mailed Feb. 4, 2021.

(Continued)

*Primary Examiner* — Cheng Lin
(74) *Attorney, Agent, or Firm* — Collard & Roe, P.C.

(57) ABSTRACT

The invention relates to a machine for stabilising a track with a ballast bed, comprising a machine frame supported on rail-based running gears and a stabilising unit which can be rolled on rails of the track by means of work unit rollers, and which comprises a vibration exciter for generating a dynamic impact force as well as a loading device for generating a load acting on the track. Therein, the loading device is coupled with a control device for periodically changing the load during a stabilising process. The periodic change of the load alternately influences the near and far range of the load application. This leads to improved compaction effectiveness compared to a constant load.

7 Claims, 4 Drawing Sheets

(56) References Cited

U.S. PATENT DOCUMENTS

| | | | | | |
|---|---|---|---|---|---|
| 5,640,909 | A * | 6/1997 | Theurer | E01B 27/13 104/2 |
| 6,154,973 | A * | 12/2000 | Theurer | E01B 27/17 33/651 |
| 11,821,147 | B2 * | 11/2023 | Kopf | E01B 27/16 |
| 11,834,794 | B2 * | 12/2023 | Philipp | E01B 27/16 |
| 2015/0211192 | A1 | 7/2015 | Lichtberger et al. | |
| 2019/0137356 | A1 * | 5/2019 | Philipp | G01M 13/00 |

FOREIGN PATENT DOCUMENTS

| | | | | | |
|---|---|---|---|---|---|
| EP | 0 726 360 | A1 | | 8/1996 | |
| EP | 1 817 463 | A1 | | 8/2007 | |
| EP | 2 902 546 | A1 | | 8/2015 | |
| GB | 2250765 | A | * | 6/1992 | E01B 27/20 |
| JP | S51-102808 | A | | 9/1976 | |
| JP | H04-360902 | A | | 12/1992 | |
| WO | 2006/056215 | A1 | | 6/2006 | |
| WO | 2017/144152 | A1 | | 8/2017 | |
| WO | WO-2019158288 | A1 | * | 8/2019 | B06B 1/16 |

OTHER PUBLICATIONS

Austrian Search Report in Austrian Application No. A 390/2019 dated Aug. 10, 2020.

Japan Office Action in Japanese Application No. 2022-535418 dated Oct. 24, 2024 with English translation.

* cited by examiner

MACHINE AND METHOD FOR STABILISING A BALLAST TRACK

CROSS REFERENCE TO RELATED APPLICATIONS

This application is the National Stage of PCT/EP2020/081990 filed on Nov. 13, 2020, which claims priority under 35 U.S.C. § 119 of Austrian Application No. A 390/2019, filed on Dec. 10, 2019, the disclosure of which is incorporated by reference. The international application under PCT article 21(2) was not published in English.

FIELD OF TECHNOLOGY

The invention relates to a machine for stabilising a track with a ballast bed, comprising a machine frame supported on rail-based running gears and a stabilising unit which can be rolled on rails of the track by means of work unit rollers and which comprises a vibration exciter for generating a dynamic impact force as well as a loading device for generating a load acting on the track. In addition, the invention relates to a method for carrying out a stabilising process by means of the machine.

PRIOR ART

In order to restore or maintain a predefined track geometry, tracks with ballast beds are regularly worked on by means of a tamping machine. During this process, the tamping machine travels along the track and lifts the track panel formed by sleepers and rails to an overcorrected target position by means of a lifting/lining unit. The new track geometry is fixed by tamping the track using a tamping unit. Sufficient and, above all, uniform load-bearing capacity of the track ballast is an essential prerequisite for the stability of the track geometry in railway operation.

Therefore, usually a machine is used to stabilise the track after a tamping operation. During this process, the track is loaded with a static load and is set into vibration locally. The vibration causes the stones in the granular structure to become mobile, to let themselves be shifted, and to rearrange themselves with higher compactness. The resulting ballast compaction increases the load-bearing capacity of the track and anticipates compaction-induced track settlements. The increase in lateral track resistance also goes hand in hand with compaction. A corresponding method is disclosed in EP 1 817 463 A1.

Machines for stabilising a track are already known from prior art. In a so-called dynamic track stabiliser, stabilising units located between two rail-based running gears are pressed onto the track to be stabilised by means of loading devices with a vertical load. A transverse vibration of the stabilising units is transmitted to the track via work unit rollers during continuous forward travel.

A corresponding machine is known, for example, from WO 2019/158288 A1. Therein, the stabilising unit comprises a vibration exciter which has at least two unbalanced masses driven by a variably adjustable phase shift. Due to the variably adjustable phase shift, the impact force acting on the track can be changed in a targeted manner. The stabilising unit is supported against a machine frame with constant force by means of hydraulic loading drives.

PRESENTATION OF THE INVENTION

The object of the invention is to improve a machine of the kind mentioned above so that the compaction effectiveness of the track ballast is increased and that, in addition, information is obtained for a work-integrated compaction control for an assessment of the track condition. In addition, a corresponding method is to be indicated.

According to the invention, these objects are achieved by the features of independent claims 1 and 5. Dependent claims indicate advantageous embodiments of the invention.

Therein, the loading device is coupled with a control device for periodically changing the load during a stabilising process. The frequency of the periodic change of the load is significantly lower than the vibration frequency of the vibration exciter. The increase in compaction effectiveness achieved in this way is due to soil-mechanical behaviour. With new track ballast, so-called ballast flowing occurs under dynamic load. In this state, the ballast stones of the granular structure shift and rearrange themselves with higher compactness. By periodically increasing the load, ballast flowing in the load application area is prevented locally, so that the compaction effect temporarily becomes more far-reaching. The periodic change of the load alternately influences the near and far range of the load application. This leads to improved compaction effectiveness compared to a constant load. With a constant load, ballast flowing leads to an increased dynamic decoupling between dynamic excitation and the far range of the load application.

A significant advantage of the invention is shown in ballast compaction with changing ballast and subsoil characteristics, because the load according to the invention fluctuates periodically and leads to optimum compaction effectiveness even under changing conditions. Especially with old and dirty track ballast, where no ballast flowing occurs, the invention shows considerable improvements in ballast compaction.

In an advantageous further development of the invention, sensors are arranged to record a progression of a force acting on the track from the stabilising unit, with measurement signals from the sensors being fed to an evaluation device and with the evaluation device being set up to determine a characteristic value derived from the progression of the force. The stabilising unit and ballasted track form a dynamic interaction system whose state of movement provides information about the characteristics of the track ballast condition. In this way, a work-integrated dynamic compaction control and an assessment of the track condition are carried out, wherein the targeted variation of the process parameters provides additional information. The load has a significant effect on the friction between the sleeper undersides and the track ballast. In the evaluation of the compaction control during the process, a clearer distinction can thus be made between ballast stiffness and ballast condition as well as lateral track resistance.

A further improvement provides that for controlling a process parameter, a control loop is set up with a controller, a setting device for the loading device, and a measuring device for recording the process parameter. Controlling at least one process parameter enables an automatic adaptation of the stabilising process to changed conditions in the dynamic interaction system stabilising unit-track panel-track ballast.

An advantageous expansion provides that a further stabilising unit is arranged, with a further loading device which is coupled with the control device for generating a periodically changed load. This makes it possible to operate both stabilising units in such a way that there are adjusted to one another in order to achieve better compaction effectiveness.

In the method according to the invention for carrying out a stabilising process by means of the machine described, the track is set into vibration by means of the stabilising unit, wherein a periodically changed load is exerted on the track by means of the loading device during the stabilising process.

For dynamic compaction control and for assessing the track condition, it is advantageous if a progression of a force acting on the track from the stabilising unit is recorded by means of sensors, with measurement signals from the sensors being evaluated by means of an evaluation device to determine a characteristic value derived from the force progression.

A further improvement of the method provides that a vibration frequency that is adjusted to an interval of the periodically changed load is predefined for the vibration exciter. Especially when several stabilising units are arranged one after another, it is useful to also take the driving speed into account. With optimal adjusting, the vibration frequency of the vibration exciter is at least one power of ten higher than the frequency of the periodically changed load.

Advantageously, at least two stabilising units arranged one behind another are operated together, each with its own loading device. In this case, an individual progression of the load acting on the track can be achieved with each loading device.

Two favourable modes of operation provide for the two loading devices to be operated synchronously or asynchronously, so that both stabilising units exert the same load on the track in synchronous operation and different loads in asynchronous operation. For compaction control during the process, synchronous operation is preferable. The advantage of asynchronous operation is a constant load on the machine frame, because both stabilising units are not supported against the machine frame at the same time with the same reaction force.

The method with several stabilising units is improved by the fact that an interval is predefined for the periodically changed load that is adjusted to a driving speed of the machine. It is useful to adjust the interval of the pulsating load to the driving speed in such a way that those areas which are worked on by the leading stabilising unit with the lowest load are worked on by the trailing stabilising unit with the highest load and vice versa.

This adjustment is possible for both synchronous and asynchronous operation. Within this bandwidth, the interval of the pulsating load is selected in such a way that the range of influence of the stabiliser leads to overlaps (not changing too slowly), but the speed of the load change still allows stationary vibration states in the dynamic track stabilisation (not changing too quickly).

BRIEF DESCRIPTION OF THE DRAWINGS

In the following, the invention is explained by way of example with reference to the accompanying figures. The following figures show in schematic illustrations.

DESCRIPTION OF THE EMBODIMENTS

Figure 1:
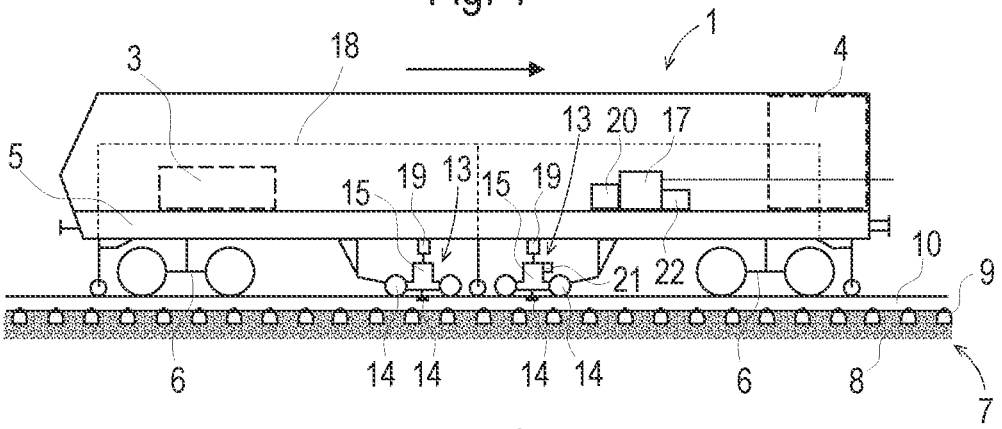
FIG. 1 Stabilising machine with two stabilising units.

The machine according to the invention is designed either as an independent stabilising machine 1 (FIG. 1) or as a combined machine with a tamping machine 2 (FIG. 2) and a stabilising machine 1 coupled to it. In the case of an independent stabilising machine 1, it has its own travel drive 3 and its own driver's desk 4. The machine 1 comprises a machine frame 5 that is movable on rail-based running gears 6 on a track 7.

The track 7 is a ballasted track with a track panel positioned in a ballast bed 8. The track panel consists of sleepers 9 and rails 10 fastened to them. To correct the track geometry, the track panel is lifted into a new position with a lifting/lining unit 11 of the tamping machine 1. The track panel is fixed in the new position by tamping the track ballast under the sleepers 9 by means of a tamping unit 12.

To ensure that the new track geometry remains stable after working and that the lateral track resistance of the track 7 returns to the required level after maintenance, the stabilising machine 1 is used. This machine is also called Dynamic Track Stabiliser (DGS). The aim is to bring the track ballast, which has been partially loosened by tamping the track 7, into a stable, more compact position by means of optimum subsequent compaction using the stabilising machine 1.

Figure 2:
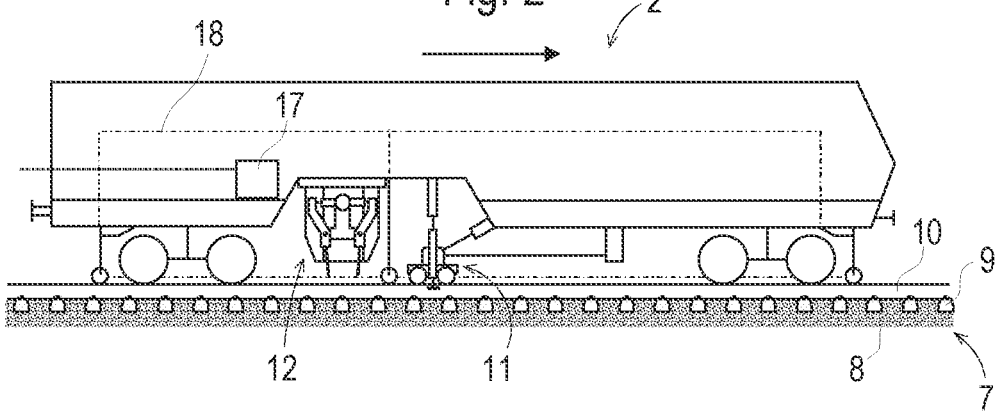
FIG. 2 Tamping machine.

For this purpose, the stabilising machine 1 shown in FIG. 1 comprises two stabilising units 13 arranged one behind another with work unit rollers 14 for holding the rails 10. In a simple embodiment, only one stabilising unit 13 is arranged. In operation, the respective stabilising unit 13 is set into vibration in the transverse direction of the track by means of a vibration exciter 15. The work unit rollers 14 transmit the vibration to the track panel, which dynamically excites the track 7. During the process, the track ballast vibrates in an area of influence 16 of the stabilising unit 13, which leads to a compaction of the ballast. The vibration frequency of the vibration exciter 15 is usually in the range of 33-42 Hz.

For controlling the stabilising unit 13 and the travel drive 3, the stabilising machine 1 comprises a machine control 17. The machine control 17 may be coupled with a machine control 17 of the tamping machine 2. In addition, both the tamping machine 2 and the stabilising machine 1 comprise a chord measuring system 18 for determining the track geometry.

The respective stabilising unit 13 is supported against the machine frame 5 by a loading device 19. The loading device 19 comprises, for example, two hydraulic cylinders which are linked to longitudinal carriers of the machine frame 5 on both sides. By means of the loading device 19, the associated stabilising unit 13 is pressed against the track 7 with a vertical load F.

According to the invention, a periodic change of this load F takes place during a stabilising process. This targeted impressing of a cyclic fluctuation increases the compaction effectiveness compared to a stabilising process with static vertical load. For this purpose, the loading device 19 is coupled with a control device 20. Specifically, a control program is set up in the control device 20 that predefines a periodically changed control variable for the loading device 19. Advantageously, the control device 20 is connected to or integrated in the machine control 19 in order to adjust the driving speed v of the stabilising machine 1 and the periodic change of the load F to one another. The frequency of the periodically changed load F is, for example, 1 Hz and is thus clearly below the vibration frequency of 33-42 Hz of the vibration exciter 15.

It is useful to have each worked on section of the track 7 experience the different dynamic conditions that occur at a minimum load F, at a maximum load F, and in the transition area in between. In this way, all favourable soil-dynamic effects are exploited. A time interval i for a load cycle of the load F is considered. This interval i of the periodically changed load F must be adjusted to a spacing a between the two stabilising units 13, the mode of operation (synchronous or asynchronous), and a driving speed v of the stabilising machine 1. Specifically, at each point where a maximum load F has been applied to the leading stabilising unit 13, the trailing stabilising unit 13 is to be loaded with the minimum load F and vice versa.

In the process, the compactable area of influence 16 shown in FIGS. 3-8 must be taken into account. On the one hand, there should be no gaps in the optimal compaction (interval i is too long), on the other hand, too rapid of a load change would prevent desired stationary vibration states of the dynamic horizontal vibration (interval i is too short).

Stationary vibration states are important to successfully apply work-integrated compaction control. With the load variation according to the invention, the compaction control and the assessment of the track condition are extended with additional possibilities. Details of the determination of characteristic values for compaction control and for the assessment of the track condition can be found in the Austrian patent application A 331/2018, the content of which is incorporated in the present application. Sensors 21 for the recording of measuring signals and an evaluation device 22 for the recording of characteristic values are arranged on the stabilising unit 13.

In synchronous operation, all stabilising units 13 are cyclically loaded with the same load F. The stabilising units 13, the track panel, and the underlying track ballast thus form a shared dynamic interaction system. This facilitates the interpretation of the measuring results within the scope of the work-integrated dynamic compaction control.

However, alternating stress on the machine frame 5 may be undesirable. In asynchronous operation, this alternating stress is eliminated because a total force of both stabilising units 13 on the machine frame 5 remains constant. Only the load F is cyclically redistributed between the two stabilising units 13 so that the load on one unit goes hand in hand with the relief of the load of the other stabilising unit 13. One stabilising unit 13 then reaches the maximum max of the load F when the other stabilising unit 13 experiences the minimum min of the load F.

FIGS. 3-6 show the load relations in a uniform representation. The lower areas show the spatial arrangement of the stabilising units 13. Above each of them, a time-distance diagram is arranged, showing a distance s covered by the stabilising machine 1 over time t. At a constant driving speed v, there is a direct correlation between the covered distance s (location) of the respective stabilising unit 13 and the time t. Therefore, the distance s is plotted on the abscissa and the time t on the ordinate. With a distance interval Δs and a time interval Δt, the following relationship applies to the speed v:

$$v=\Delta s/\Delta t$$

The respective diagram shows at which time t the stabilising units 13 are at which location. In addition, minimum loads min (minimum load F) and maximum loads max (maximum load F) are drawn along a load path 23 of the front stabilising unit 13 and along a load path 24 of the rear stabilising unit 13 with time t and distance s (location). Thus, the advantageous condition can be fulfilled that in those locations where the front stabilising unit 13 experiences a maximum load max, the rear stabilising unit 13 has a minimum load min, and vice versa.

Figure 5:
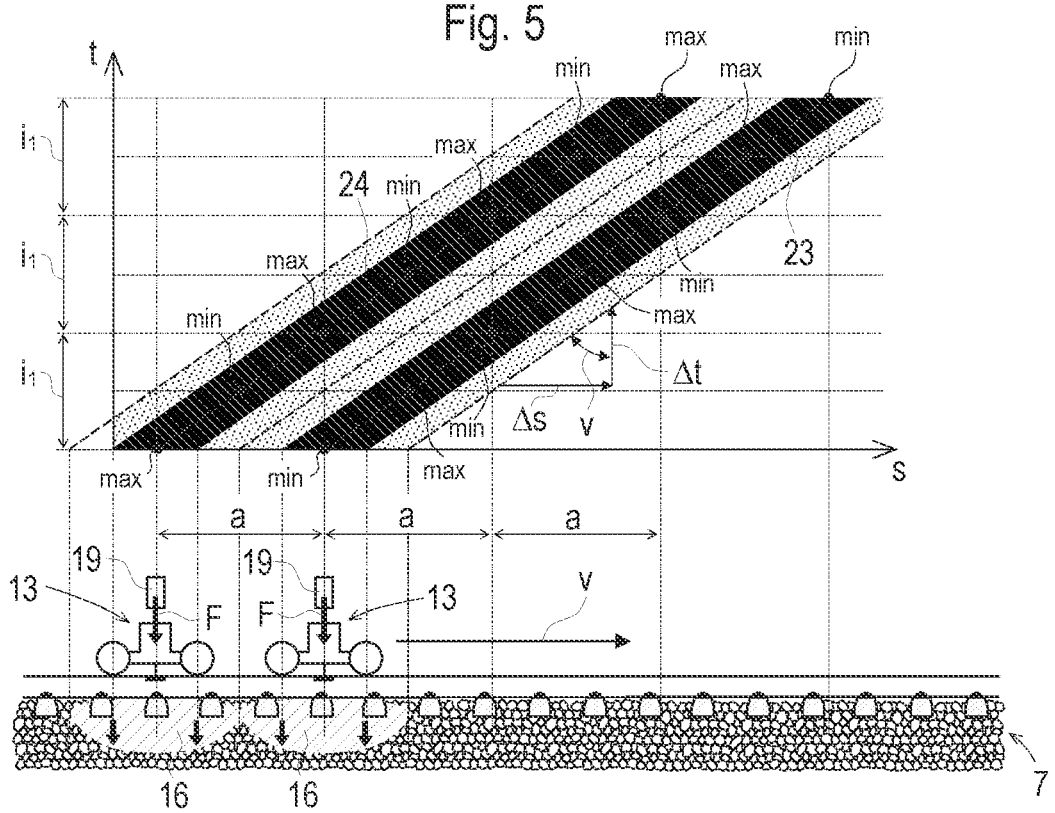
FIG. 5 Load path of the stabilising units in asynchronous operation with the largest load interval (fundamental vibration) in the distance-time diagram with the corresponding arrangement of the stabilising units.
Figure 6:
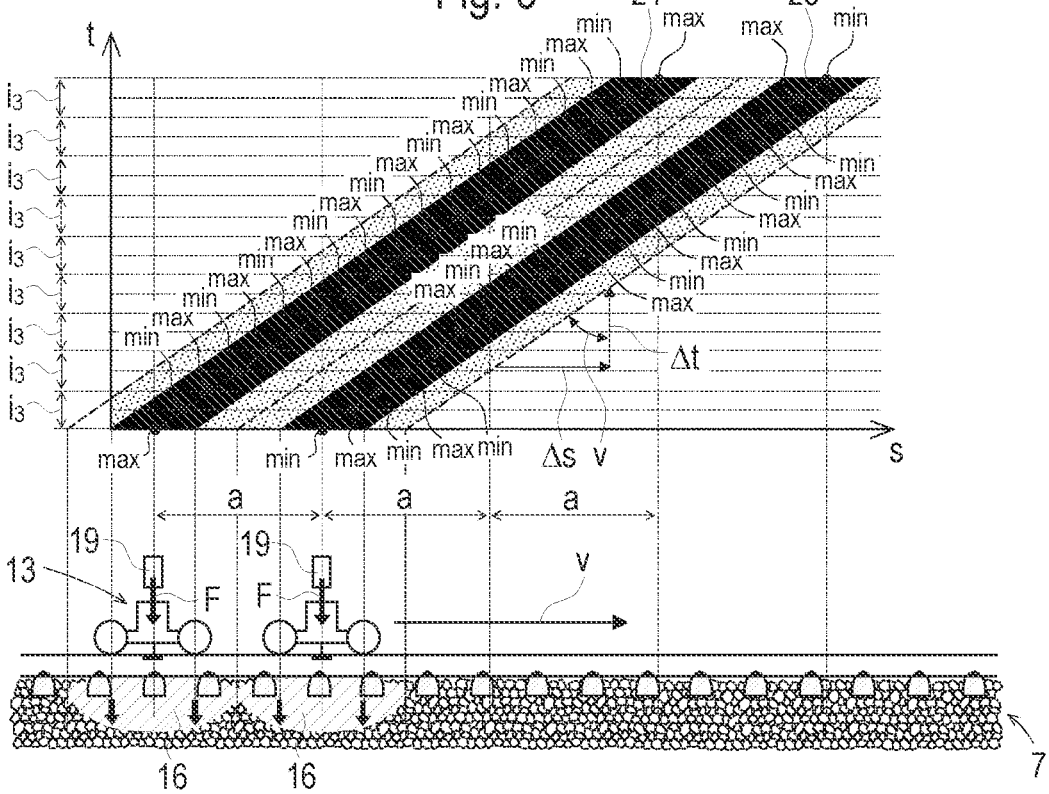
FIG. 6 Load path of the stabilising units in asynchronous operation with the third largest load interval (second overtone) in the distance-time diagram with the corresponding arrangement of the stabilising units.

If the stabilising units 13 operate in synchronous operation (FIGS. 3 and 4), the maximum load max of both stabilising units 13 occurs at the same time. The same applies to the minimum load min. In asynchronous operation, at a time with maximum load max of the one stabilising unit 13, the other stabilising unit 13 has a minimum load min (FIGS. 5 and 6).

In all modes of operation, the formulated advantageous condition of different loads min, max in the same location applies. The longest interval i of the periodically changed load F for which this condition is fulfilled is that interval i which corresponds to the fundamental vibration of the variable load F. The interval i is independent of the spacing a between the stabilising units 13, the driving speed v, and the mode of operation (synchronous or asynchronous).

Figure 3:
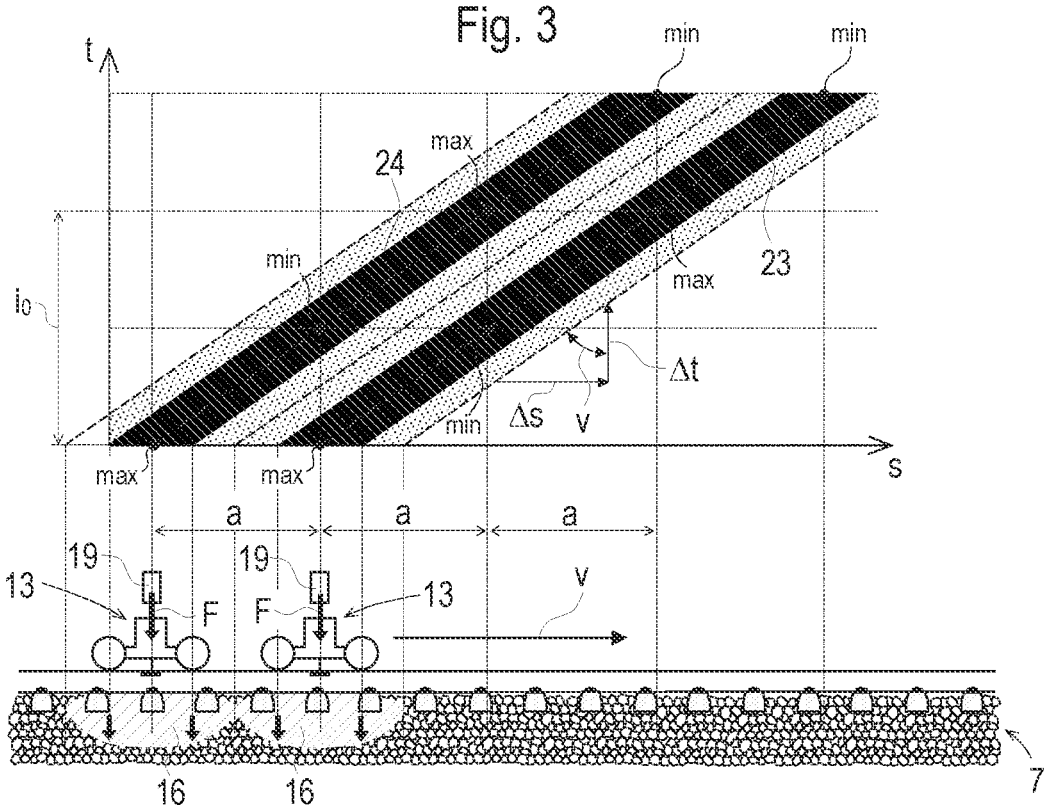
FIG. 3 Load path of the stabilising units in synchronous operation with the largest load interval (fundamental vibration) in the distance-time diagram with the corresponding arrangement of the stabilising units.

According to the illustration in FIG. 3, the following relationship results during synchronous operation for the interval i, of the fundamental vibration with the spacing a between the stabilising units 13 and the driving speed v of the stabilising machine 1:

$$i_0=2\cdot a/v$$

The following formula applies to the respective interval in of the overtones in the load path 23, 24 of the respective stabilising unit 13 in synchronous operation:

$$i_n=(2\cdot a/v)/(2\cdot n+1) \text{ for } n=1,2,3,\ldots.$$

Figure 4:
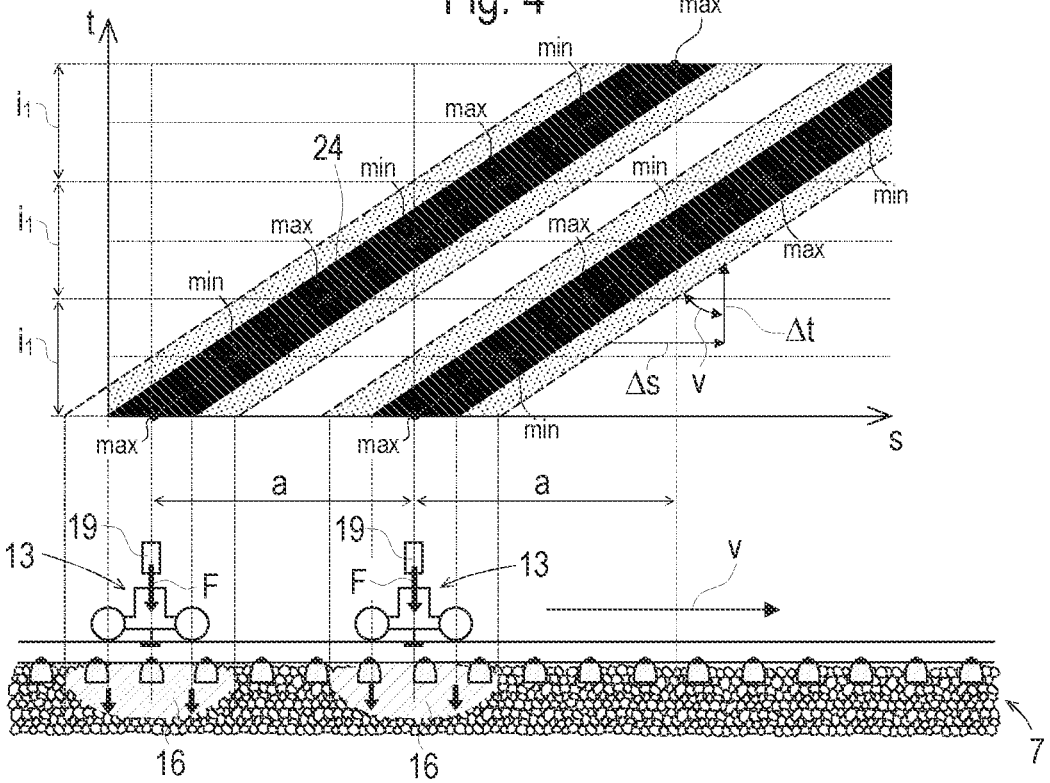
FIG. 4 Load path of the stabilising units in synchronous operation with the second largest load interval (first overtone) in the distance-time diagram with the corresponding arrangement of the stabilising units.

The first overtone is shown in FIG. 4. It is useful to select an overtone at a low driving speed v and at a large spacing a between the stabilising units 13.

In asynchronous operation, the following relationship results for the interval i, of the fundamental vibration (FIG. 5):

$$i_1=a/v$$

In general, the following formula applies to the respective interval in in asynchronous operation in the load path 23, 24 of the two stabilising units:

$$i_n=a/(n\cdot v) \text{ for } n=1,2,3,\ldots.$$

In the case of a large spacing a between the stabilising units 13 with a gap between the individual areas of influence 16, a higher frequency overtone of the changing load F is advantageously selected (FIG. 4 for synchronous operation).

Even at very low speeds v, selecting a higher-frequency overtone of the load F can be useful. FIG. 6 shows the third harmonic, i.e. the second overtone (n=3), as an example for asynchronous operation.

Figure 7:
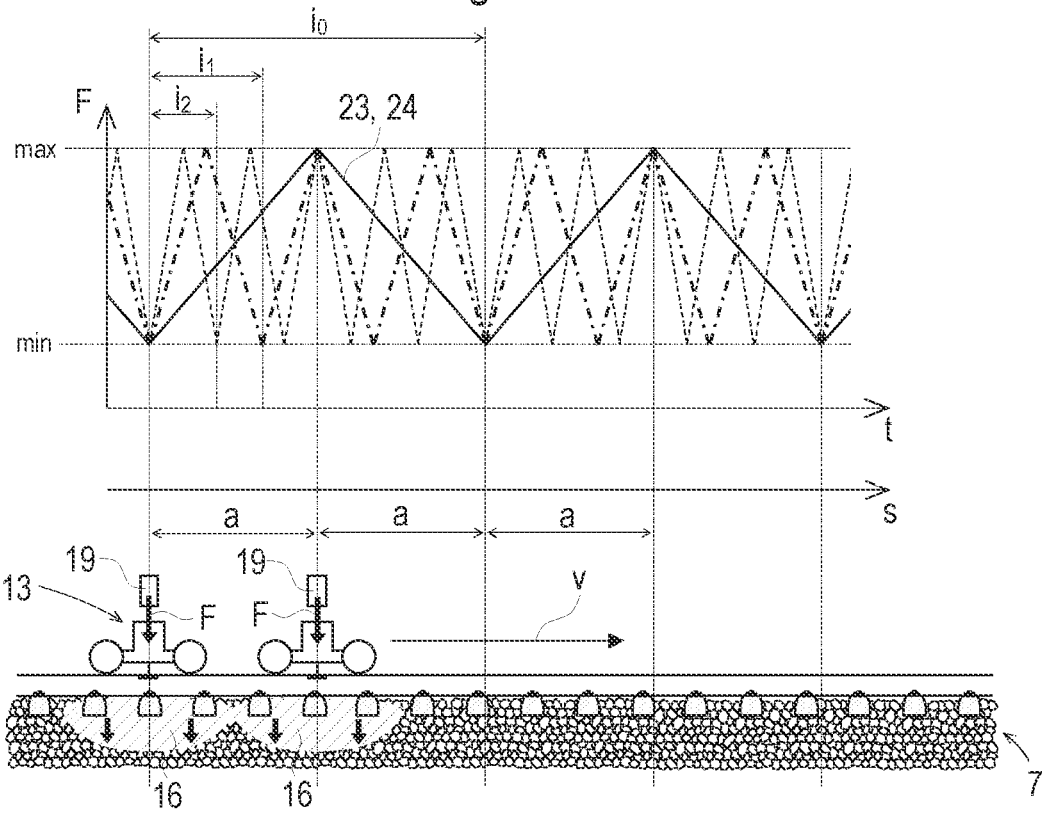
FIG. 7 Change of the load of both stabilising units in synchronous operation in fundamental vibrations and overtones with the associated distance representation at constant driving speed over time.
Figure 8:
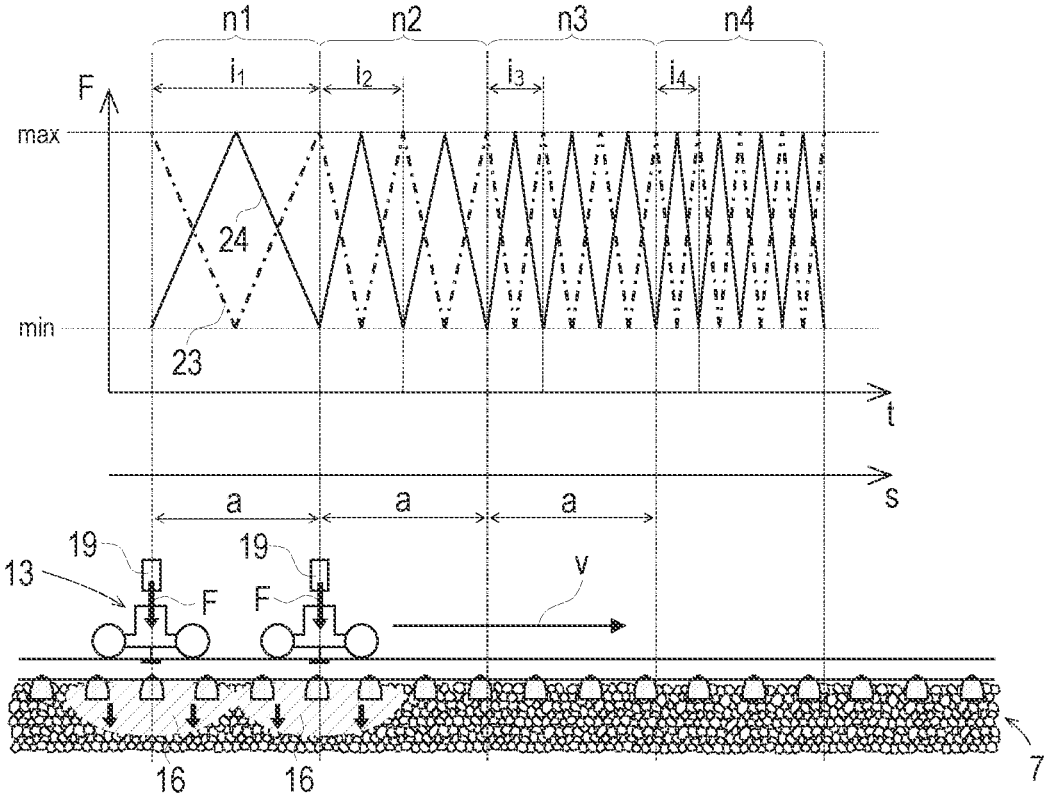
FIG. 8 Change of the different load of both stabilising units in asynchronous operation, shown one after another in the fundamental vibration and three overtones with associated distance representation at constant driving speed over time.

FIGS. 7 and 8 show the progression of the load F over time. The geometric relationship of the stabilising units 13 is shown below for constant driving speed v, with the following relationship:

$$t=s/v.$$

FIG. 7 shows the fundamental vibration for synchronous operation as a solid line, with the corresponding interval $i_0=2\cdot a/v$. The first overtone is shown with a dash-dotted line, with a shorter interval $i_1=(2\cdot a/v)/3$ The second overtone is shown with a dashed line, with the interval $i_2=(2\cdot a/v)/5$ For asynchronous operation, FIG. 8 shows the progression of the load F for the one stabilising unit 13 with a solid line (load path 23) and for the other stabilising unit 13 with a dash-dotted line (load path 24). The fundamental vibration n1 and the first three overtones n2, n3, n4 are drawn one after the other in chronological order. For the respective interval $i_1$, $i_2$, $i_3$, $i_4$ the following applies again:

$$i_n=a/(n\cdot v) \text{ for } n=1,2,3, \ldots .$$

Figure 9:
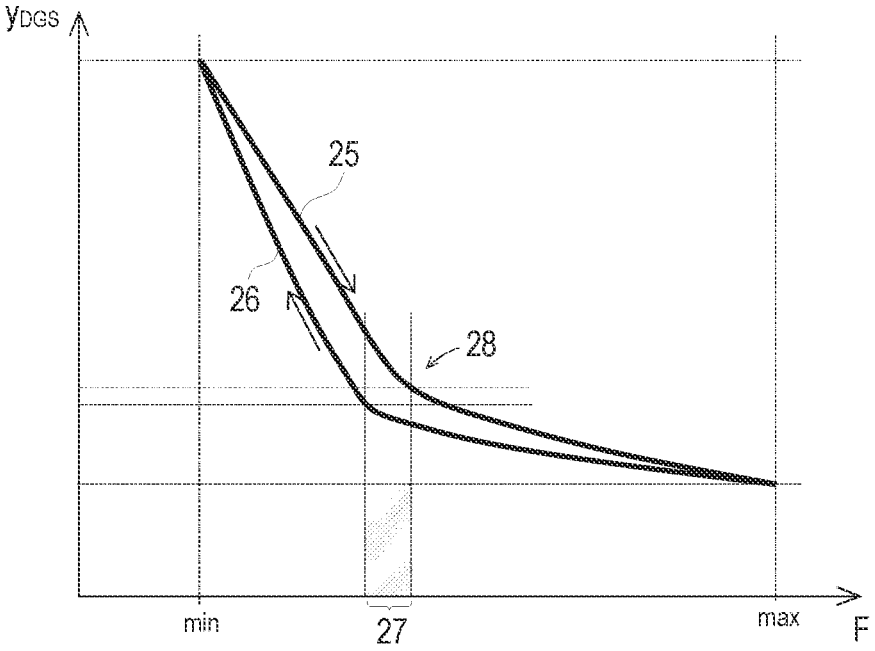
FIG. 9 Diagram of a horizontal vibration amplitude of a stabilising unit plotted over the load.

FIG. 9 shows the additional benefit of varying the load F when using the work-integrated dynamic compaction control. As an example, the idea is shown using the horizontal vibration amplitude $y_{DGS}$ of the stabilising unit 13. This changes depending on the load F. The horizontal vibration amplitude $y_{DGS}$ of the stabilising unit 13 is representative of all the measurement and calculation variables described in Austrian patent application A 331/2018 as well as additional measurements such as the vibrations in the environment (size and shape of the wave propagation).

As the load F increases, the amplitude $y_{DGS}$ decreases in a first section 25. During the subsequent relief of the load, the amplitude $y_{DGS}$ increases again in a second section 26. Due to hysteresis, the two sections 25, 26 do not run on the same line. However, both sections 25, 26 show a discernible bend 28 in a narrow load area 27, which is an indication of a system change in the dynamic interaction system stabilising unit-track panel-track ballast. The position of this system change is an additional indicator for the ballast condition and correlates with the lateral track resistance of the track 7. This indicator can also be used for automatic control of the process parameters.

The invention claimed is:

1. A machine for stabilizing a track with ballast bed, comprising:

a machine frame supported on rail-based undercarriages and a stabilizing unit which can be rolled on rails of the track by means of work unit rollers, and which comprises a vibration exciter for generating a dynamic impact force; and a loading device for generating a load acting on the track, wherein the loading device is coupled with a control device for periodically changing the load during a stabilizing process;

wherein two stabilizing units arranged one behind the other, each stabilizing unit with its own loading device, are operated together;

wherein an interval, adjusted to a driving speed of the machine, is predefined for the periodically changed load.

2. The machine according to claim 1, wherein sensors are arranged for recording a progression of a force acting on the track from the stabilizing unit, in that measuring signals from the sensors are transmitted to an evaluation device and in that the evaluation device is set up to determine a characteristic value derived from the progression of the force.

3. The machine according to claim 1, wherein for controlling a process parameter, a control loop is set up comprising a controller, a setting device for the loading device, and a measuring device for recording a process parameter.

4. The machine according to claim 1, wherein a further stabilizing unit is arranged, with a further loading device which is coupled with the control device for generating a periodically changed load.

5. The method according to claim 1, wherein a progression of a force acting on the track from the stabilising unit is recorded by means of sensors and in that measuring signals from the sensors are evaluated by means of an evaluation device to determine a characteristic value derived from the progression of the force.

6. The method according to claim 1, wherein the two loading devices are operated synchronously or asynchronously so that both stabilizing units exert the same load on the track in synchronous operation and different loads in asynchronous operation.

7. A machine for stabilising a track with ballast bed, comprising:

a machine frame supported on rail-based undercarriages and a stabilizing unit which can be rolled on rails of the track by means of work unit rollers, and which comprises a vibration exciter for generating a dynamic impact force; and a loading device for generating a load acting on the track, wherein the loading device is coupled with a control device for periodically changing the load during a stabilizing process wherein the track is set into vibration by means of the stabilizing unit, wherein during the stabilizing process a periodically changed load is exerted on the track by means of the loading device;

wherein two stabilizing units arranged one behind the other, each with its own loading device, are operated together;

wherein an interval, adjusted to a driving speed of the machine, is predefined for the periodically changed load.

* * * * *